United States Patent [19]

Peace

[11] 4,363,932

[45] Dec. 14, 1982

[54] ELECTROSTATIC PRECIPITATOR INSULATOR CONSTRUCTION

[76] Inventor: Edward R. Peace, 1052 Galatea, Azusa, Calif. 91702

[21] Appl. No.: 275,936

[22] Filed: Jun. 22, 1981

[51] Int. Cl.[3] ..... H01B 17/00

[52] U.S. Cl. ..... 174/138 R; 55/146; 55/147; 55/152

[58] Field of Search ..... 55/146–148, 55/150–153; 174/138 D, 74 A, 138 E, 138 R; 429/65; D13/17, 18; 29/631, 463; 220/4 B

[56] References Cited

U.S. PATENT DOCUMENTS 1,592,175 7/1926 Boyd ..... 204/196

2,134,302 10/1938 Haushaller ..... 277/237

3,354,617 11/1967 Hoisington et al. ..... 55/148

3,918,120 11/1975 Yoshikawa ..... 174/74 A

*Primary Examiner*—Bernard Nozick

*Attorney, Agent, or Firm*—Boniard I. Brown

[57] ABSTRACT

An insulating structure for cooperation with an associated electrostatic precipitator having a generally U-shaped member supporting a depending weight. The insulating structure includes a section of a generally planar, generally circular first body which has a depending peripherally disposed flange extending about at least a part thereof and has a slot disposed in the section of the generally planar generally circular first body.

7 Claims, 8 Drawing Figures

ELECTROSTATIC PRECIPITATOR INSULATOR CONSTRUCTION

BACKGROUND OF THE INVENTION

The invention relates to insulating structures which are particularly adapted for use in electrostatic precipitators which are also known as scrubbers. While having particular application to use in electrostatic precipitators utilized in sulphuric acid plants, it will be understood that it also has application to other electrostatic precipitators and other apparatus.

Sulphuric acid does not occur as a free acid in nature. Most sulphuric acid is produced by a contact process which has the advantage that the acid can be obtained in any desired concentration. In the contact process, sulphur dioxide and other gases are obtained by roasting iron pyrites in a kiln. Dust in the gases is removed in electrostatic precipitators.

The basic operating principle of the electrostatic precipitator is demonstrated by the familiar experiment in which a glass rod is rubbed with a silk cloth. The rod is thereby given an electrostatic charge, making it capable of attracting uncharged bits of paper, lint, or cork. In the electrostatic precipitator, it is the collecting surfaces that are grounded, while a charge is created on the particles which are to be collected.

The power supply in such apparatus typically steps up line voltage and rectifies it to produce 50,000 volts of direct current. The direct current voltage is applied to a plurality of discharge electrode wires suspended in the gas flow path. The high potential on the discharge electrodes causes a corona discharge, from which electrons migrate out into the gas. These create gas ions, which attach themselves to particles in the gas and give the particles a charge.

Grounded collecting electrodes are also provided. The high potential difference results in a powerful electric field through which the gas is directed. In accordance with Coulomb's law, the field exerts a force on a charged particle in the field. This force moves particles out of the gas stream to the collecting electrodes. At the grounded collecting electrodes, the particles lose their charge. If the particles are in the form of dust, they are typically urged by gravity to a collecting area.

A problem associated with electrostatic precipitators of known construction is that the mounting of the electrodes does not adequately insure that arcing does not occur between the discharge and collecting electrodes and between various other elements. This arcing deteriorates the lead covered discharge electrodes and most importantly decreases the effectiveness of the electrostatic precipitator. The decrease in efficiency of such apparatus typically is in the order of 25% or more between annual service procedures. The inadequate relative positioning of the electrodes also results in major shutdowns of associated process apparatus. Because of environmental regulations, the shutdown of electrostatic precipitators will also necessarily result in the shutdown of all process equipment associated therewith. Such shutdowns frequently require the replacement of numerous components and substantial labor expense. The labor expense is particularly significant since the work is highly specialized and ordinarily requires outside technicians who may not be able to schedule their repair work promptly.

It is an object of the invention to provide apparatus which will more precisely orient the discharge and collecting electrodes to minimize arcing, down time and repairs, and to maximize efficiency of such electrostatic precipitators.

It is another object of the invention to provide apparatus which may be very inexpensively manufactured with manufacturing techniques which will utilize known plastic molding techniques.

Another object of the invention is to provide an insulating structure which may be easily installed on existing electrostatic precipitators.

SUMMARY OF THE INVENTION

The foregoing objects and other objects and advantages which shall become apparent from the detailed description of the preferred embodiment are attained in an apparatus which includes an insulating structure for cooperation with an associated electrostatic precipitator having a generally U-shaped member supporting a depending weight. The insulating structure includes a first member which is a section of a generally planar, generally circular first body and which has a depending peripherally disposed flange extending about at least a part thereof and has a slot disposed in the section of the generally planar, generally circular first body.

The first member of the insulating structure may include a first cylindrical section which is disposed in generally aligned relationship with the periphery of the slot. The insulating structure which may include a second member which is a section of a generally planar, generally circular second body which has a depending peripherally disposed flange extending about at least a part thereof.

The insulating structure may include a second cylindrical section which may be disposed in generally aligned relationship with the periphery of the slot. The first and second members may be provided with cooperting step shaped surfaces. The flange or the first member may extend beyond the extent of the section of the generally planar, generally circular body. The depending flange or the second member may have axial extremities which may be recessed from the periphery of the section of the generally planar, generally circular body thereof. The section of the generally planar, generally circular first body may have an edge thereof which may be rectilinear. The section of the generally planar, generally circular second body may have an edge thereof which is rectilinear.

BRIEF DESCRIPTION OF THE ACCOMPANYING DRAWING

DESCRIPTION OF THE PREFERRED EMBODIMENT

Figure 1:
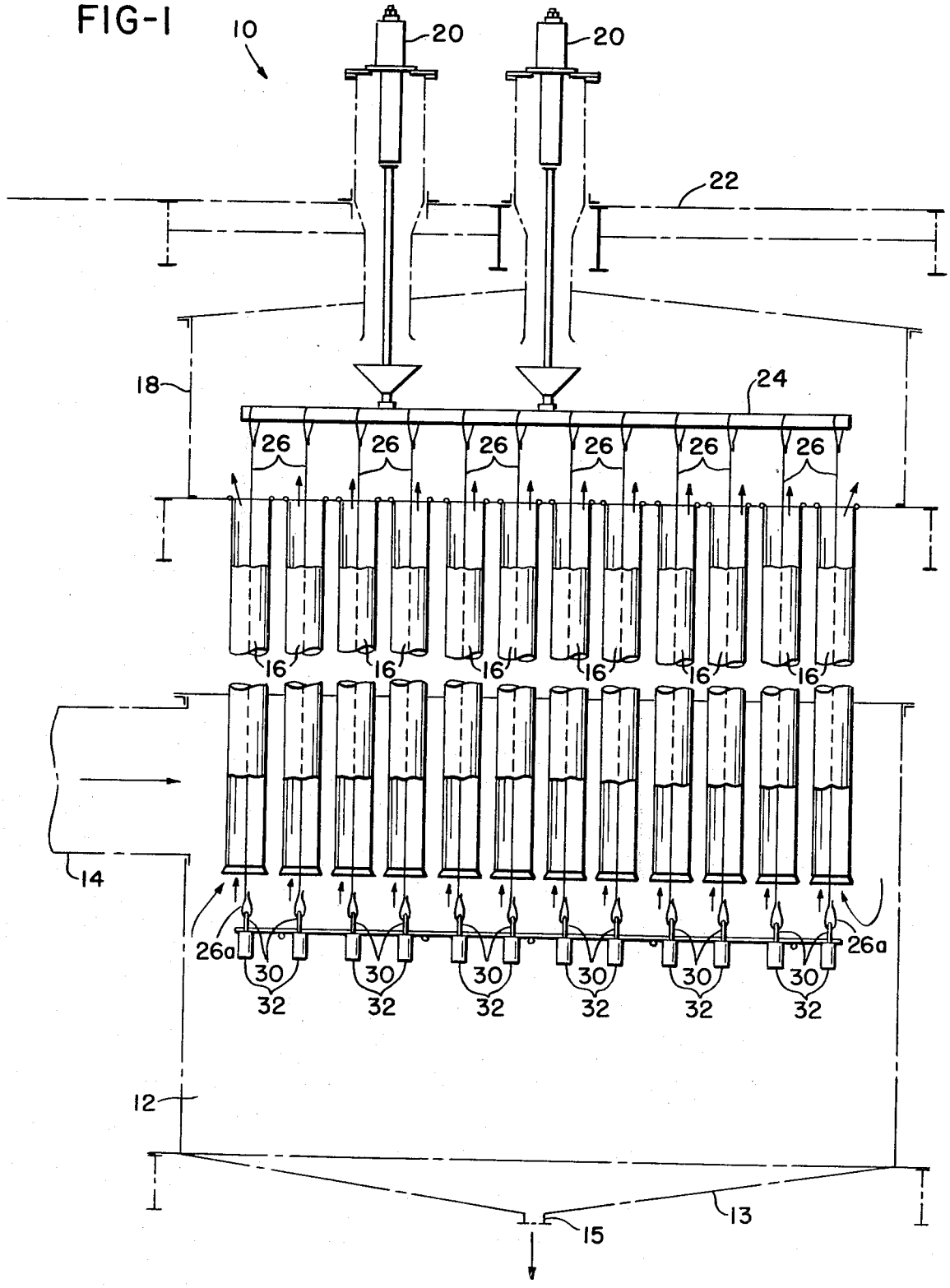
FIG. 1 is a schematic view showing a vertical cross-section of an electrostatic precipitator.
Figure 2:
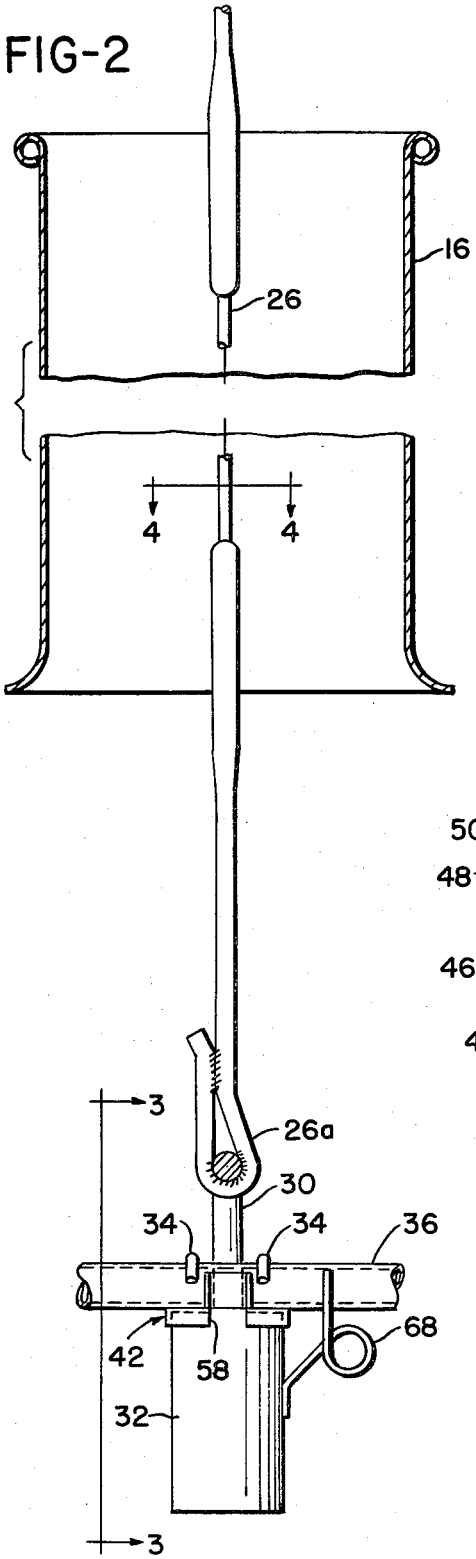
FIG. 2 is an enlarged view of a portion of the apparatus illustrated in FIG. 1.
Figure 3:
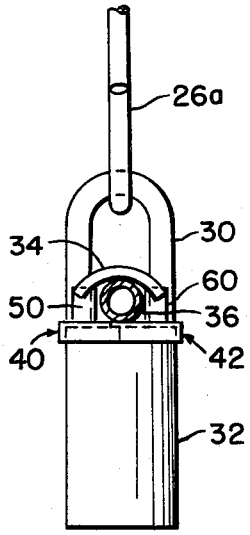
FIG. 3 is an elevational view taken along the lines 3—3 of FIG. 2.

Referring now to FIGS. 1–7, there is shown a scrubber or electrostatic precipitator 10 which utilizes the apparatus in accordance with the invention. The apparatus includes a lower chamber 12 having an inlet 14 for contaminated gas. The lower chamber 12 is provided with a tapered lower extremity 13 which includes a spout 15 which communicates with a reservoir for solid material there which is precipitated out. Ordinarily gravity will be sufficient to direct the precipitated material to the spout 15 and thence to a closed chamber (not shown). The contaminated gas is forced upwards through a plurality of tubes 16 which are typically approximately ten inches in diameter. A typical precipitator 10 may have approximately twenty of the tubes 16. The tubes 16 are ordinarily coated with lead because the contaminated gases ordinarily will be highly corrosive and steel, cast iron and other pipes would be rapidly attached by such corrosive gases.

Figure 4:
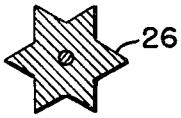
FIG. 4 is a sectional view taken along the line 4—4 of FIG. 2.
Figure 5:
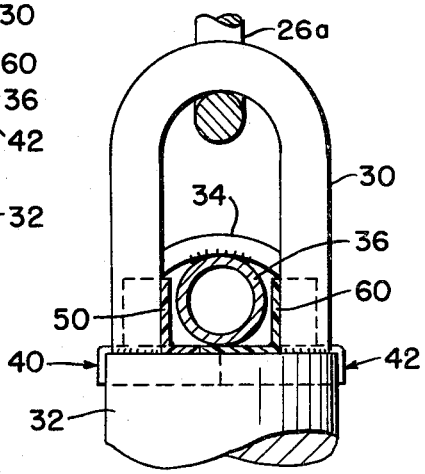
FIG. 5 is an enlarged elevational view, in partial section, similar to FIG. 3.

The gas exiting from the tube 16 passes into an upper chamber 18 having an exit duct (not shown). Electrodes 20, 20 extend through a floor 22 and are coupled to a support pipe 24. Extending downwardly from the support pipe 24 are a plurality of lead covered wires or discharge electrodes 26, which ordinarily each extend in congruent relationship with the axis of one of the tubes 16. As best seen in FIG. 4, the wires 26 each have a generally star shaped cross-section. The wires 26 ordinarily are maintained at approximately 50,000 volts DC by a power supply (not shown) which is connected to the electrodes 20, 20 which are of course connected to the wires 26 via the pipe 24. Ordinarily the wires 26 are lead covered, as are the tubes 16, to protect against the corrosive effects of the gases which pass over them.

The lower axial extremity 26*a*, of each wire 26, is provided with a generally U-shaped end 26*a* which cooperates with a generally U-shaped member 30. The generally U-shaped member 30 is fixed to a weight 32. Typically the weight 32 will be a sixteen pound lead weight. This weight 32 serves to maintain the wire 26 at a generally vertical orientation and thus generally congruent with the axis of the tube 16 with which it is associated. A clip 34 is typically provided to hold the weight 32 and U-shaped member 30 subassembly against a stabilizing bar 36.

It will be understood that the wires 26 are vulnerable to stretching and that if a rigid mounting member were utilized at the lower axial extremity of the wires 26, any stretch would result in a "belly" which would promote arcing between the wires 26 and the tubes 16. Because of the potential difference of 50,000 volts, such arcing is of genuine concern. The lead weights insure that a constant tension is maintained on the wires 26. A stabilizing pipe 36 is provided to provide further orientation to the wire 26. Although the clip 34 may be provided in some structures, it does not insure positive contact to prevent arcing between the weight 32 and the stabilizing pipe 36. It will be understood that this arcing occurs because of the presence of static electricity. The cooperating elements ordinarily are loose fitting and there is some relative motion. Electrolysis between the lead covered steel members 32, 34 results in erosion of lead so that the steel becomes exposed and the acid gases attack and eat away the steel. The apparatus in accordance with the invention, is particularly intended to avoid this problem by providing an insulating structure to prevent any erosion of the lead.

Figure 6A:
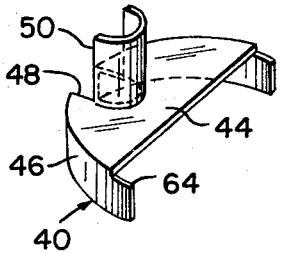
FIGS. 6A and 6B are perspective views respectively of first and second halves of insulating members in accordance with the invention.
Figure 6B:
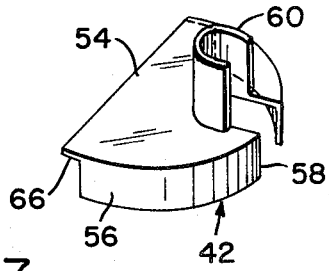
Figure 7:
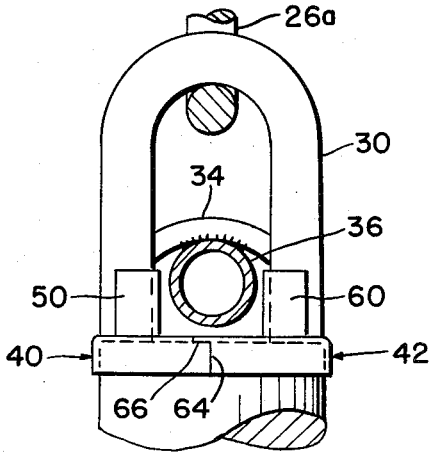
FIG. 7 is an elevational view similar to that in FIG. 5.

The insulating structure in accordance with the invention is best illustrated in FIGS. 6A and 6B. The insulating structure ordinarily comprises a first member or half 40 and a second member or half 42. Each half 40, 42 will ordinarily be manufactured of a plastic material. Ordinarily the plastic material will be Teflon, a Registered trademark of the E. I. Du Pont de Nemours Co., Inc. This material is also known under the generic name of FEP or TFE Flurocarbon resin.

The first half 40 of the insulating structure comprises a generally planar circular section member 44 having an arcuate depending peripheral flange 46. The flange 46 and the generally planar circular section 44 are provided with a recess or slot 48 which is disposed in generally aligned relationship with a cylindrical section 50.

In a similar manner the second half 42 of the insulating structure, comprises a generally planar, generally circular section 54 which has a depending arcuate peripherally disposed flange 56. Both the circular section 54 and the flange 56 are provided with a recess 58 which is proximate to a cylindrical section 60.

As best illustrated in FIGS. 2, 3, 4 and 7, the halves 40, 42 of the insulating structure are positioned to cooperate with the U-shaped member 30 which is fixed to the weight 32. Ordinarily the first half 40 will be positioned initially with the cylindrical section 50 engaging the left (as viewed in FIGS. 3, 4 and 7) side of the U-shaped member 30. Thereafter the second half 42 of the insulating structure is positioned with the cylindrical section 60 cooperating with the right side as viewed of the U-shaped member 30. It will be understood that the cooperating step shaped surfaces 64, 66 of respectively the first half 40 and the second half 42 cooperate to provide more positive engagement between the first and second halves 40, 42.

The stabilizer pipe 36 is connected to each weight 32 by means of a spring 68 which allows vertical motion of the weights while providing some restraint on the amount of movement of the wire 26 associated therewith.

The choice of material for insulating structure may vary in different applications. Ordinarily it will be necessary to provide a material which will be satisfactory even at temperatures of 400 degrees.

The invention has been described with reference to its illustrated preferred embodiment. Persons skilled in the art may, upon exposure to the teachings herein, conceive variations in the mechanical development of the components therein. Such variations are deemed to be encompassed by the disclosure, the invention being delimited only by the appended claims.

The inventor claims:

1. An insulating structure for cooperation with an associated electrostatic precipitator having an inverted generally U-shaped member having first and second elongated leg portions which support a depending weight, said insulating structure comprising:

a first member which includes a section of a generally planar, generally circular first body having a depending peripherally disposed flange extending about at least a part thereof;

a slot defined in said first member in said section of a generally planar, generally circular first body, said slot being dimensioned and configured for engaging the first elongated leg portion;

a cylindrical section generally aligned with the periphery of said slot in said first member, said cylindrical section having the inner surface thereof dimensioned and configured for engaging the first elongated leg portion and a second member which includes a section of a generally planar, generally circular second body having a depending peripherally disposed flange extending about at least a part thereof, said second member having a slot dimensioned and configured for engaging the second elongated leg portion.

2. The apparatus as described in claim 1, further including:

a cylindrical section generally aligned with the periphery of said slot in said second member, and having an inner surface dimensioned and configured for engaging the second elongated leg portion.

3. The apparatus as described in claim 2, wherein:

said first and second members are provided with cooperating step shaped surfaces.

4. The apparatus as described in claim 3 wherein:

said flange of said first member extends beyond the extent of said section of a generally planar, generally circular body.

5. The apparatus as described in claim 4, wherein:

said depending flange of said second member has axial extremities which are recessed from the periphery of said section of a generally planar, generally circular second body.

6. The apparatus as described in claim 4, wherein:

said section of a generally planar, generally circular first body of said first member has an edge thereof which is rectilinear.

7. The apparatus as described in claim 6, wherein:

said section of a generally planar, generally circular second body of said second member has an edge thereof which is rectilinear.

* * * * *